United States Patent [19]

Sauer et al.

[11] 4,314,389

[45] Feb. 9, 1982

[54] DOUBLE FOLD OVER JEWELRY CLASP

[75] Inventors: Alfred E. Sauer, Warwick; Bruno Tassoni, Johnston, both of R.I.

[73] Assignee: B. A. Ballou & Co., Incorporated, East Providence, R.I.

[21] Appl. No.: 81,688

[22] Filed: Oct. 4, 1979

[51] Int. Cl.[3] ..... A44B 13/00; A44B 21/00

[52] U.S. Cl. ..... 24/376; 24/241 SP

[58] Field of Search ..... 24/73 HR, 73 HH, 73 HL, 24/241 SP, 241 PP, 241 S, 265 H, 73 WW, 24

[56] References Cited

U.S. PATENT DOCUMENTS

| | | | |
|---|---|---|---|
| 1,814,475 | 7/1931 | Kestenman | 24/73 WW |
| 2,044,869 | 6/1936 | Alkin | 24/73 WW |
| 2,058,957 | 10/1936 | Dalo | 24/241 SP |
| 2,211,018 | 8/1940 | Levine | 24/241 SP |
| 2,215,526 | 9/1940 | Kestenman | 24/241 SP |

*Primary Examiner*—Roy D. Frazier
*Assistant Examiner*—Alexander Grosz
*Attorney, Agent, or Firm*—William Frederick Werner

[57] ABSTRACT

This invention relates to a jewelry clasp for securing opposite ends of a necklace chain, and more particularly to a double fold over jewelry clasp providing two sets of interlocking fastening means.

3 Claims, 9 Drawing Figures

DOUBLE FOLD OVER JEWELRY CLASP

STATEMENT OF INVENTION

This invention relates to jewelry clasps and more particularly to a jewelry clasp having two sets of fold over interlocking fastening means, with the fold over means of one set having a folding movement in a direction opposite to the folding movement of the other set.

BACKGROUND OF THE INVENTION

Jewelry clasps are used to connect the free ends of necklace chains, watch bands, strap bracelets and the like. The very nature of the clasp, the association with delicate jewelry chain requiring a small, delicate esthetic appearance, requires delicate locking means. Such locking means, however, hold extremely valuable pendants, pearls, etc., connected to the jewelry chain. The delicate nature of the clasp makes the opening and closing of the clasp a nuisance operation especially due to the ease with which the clasp or jewelry chain breaks when under the strain of opening. The locking mechanism is therefore delicate and subject ot malfunction or accidental release, resulting in the detriment of the security of the necklace.

PRIOR ART

Prior art devices such as disclosed in U.S. Pat No. 3,795,028 and British Pat. No. 469,891 acceptance date Aug. 3, 1937; No. 1,505,003 published 22 Mar. 1978 relate to bracelet clasps, but incorporate mechanisms similar to the mechanism disclosed in the present invention.

In jewelry clasps, opposite ends of an open loop are connected by clasp mechanism. In bracelet straps the clasp mechanism provides means to slidably adjust one strap in relation to the other strap. The delicate, esthetic, chain locking mechanism is not a factor to be considered.

OBJECTS OF THE INVENTION

Accordingly, it is an object of the present invention to provide an esthetic, positive acting, accident proof jewelry clasp, which is convenient to operate from closed to open and from open to closed positions.

Another object of the present invention is to provide a double fold over clasp incorporating two separate locking devices pivotally closing in opposite directions to provide a safety feature against accidental displacement of the locked position.

Still another object of the present invention is to overcome the deficiencies of prior art constructions.

And still another object of the present invention is to provide a jewelry clasp with a new and novel locking mechanism.

Other objects of the present invention will become apparent in part and be pointed out in part in the following specification and claims.

THE SPECIFICATION

Figure 1:
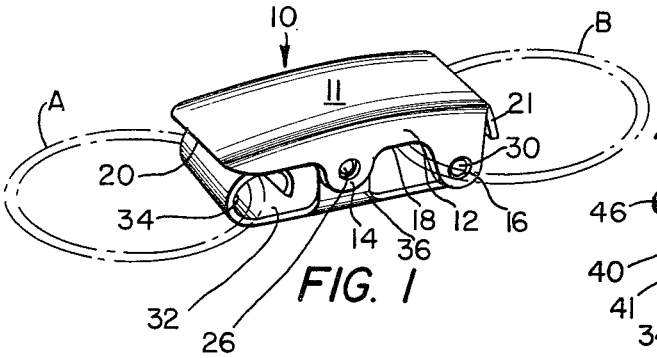
FIG. 1 is a perspective view of the new and improved double fold over jewelry clasp, shown enlarged.

Referring to the drawings, the new and improved double fold over jewelry clasp, generally indicated by numeral 10, comprises a cover body 11 having a moderately curved shape and oppositely located parallel sides 12, 13 at right angles to said cover body 11. Sides 12, 13 are shaped to provide short legs 14, 15, long legs 16, 17 and recesses 18, 19 in sides 12, 13 between, respectively, short leg 14 and long leg 16 and short leg 15 and long leg 17. Cover body 11 is formed at one end with a finger nail surface 20 and on the other end with a tail guard 21. Long legs 16, 17 are provided with pintle bearings 24, 25. Short legs 14, 15 are provided with lock openings 26, 27. A pintle 30 is fastened on opposite ends in pintle bearings 24, 25.

A clamp plate 32 is provided with one end formed into a clamp plate bearing 33 and the other end is rolled over to form a chain link eye 34. Opposite sides of clamp plate 32 are formed into two oppositely located and parallel arms 36, 37 having, respectively, hinge pin openings 38, 39. Clamp bearing 33 is oscillatably mounted upon pintle 30.

A lock plate 40 is provided on one end with a hinge plate 41 having hinge pins 42, 43 projecting from opposite sides. The other end of plate 40 is provided with a latch hook 45 and a finger nail grip 46. Lock plate 40 is oscillatably mounted to clamp plate 32 by means of hinge pins 42, 43 located in hinge pin openings 38, 39, respectively, and projecting therethrough to provide catch means for lock openings 26, 27, respectively. Latch hook 45 pivots to resiliently engage clamp plate bearing 33.

OPERATION

Figure 2:
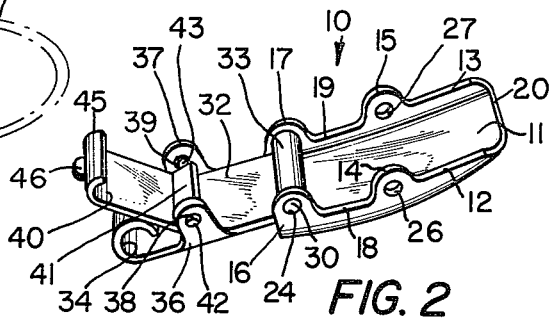
FIG. 2 is a perspective view showing the clasp in full open position.
Figure 3:
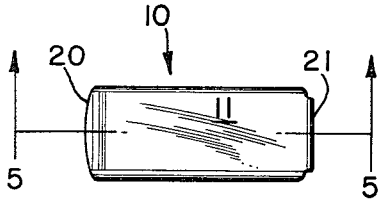
FIG. 3 is a plan view of FIG. 1.
Figure 4:
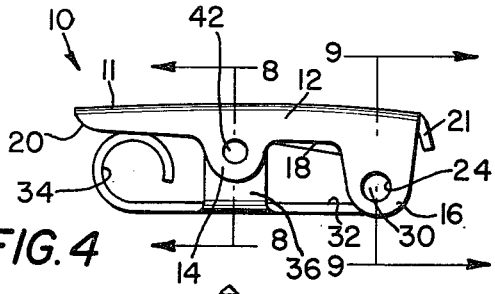
FIG. 4 is a side elevational view of FIG. 1.
Figure 5:
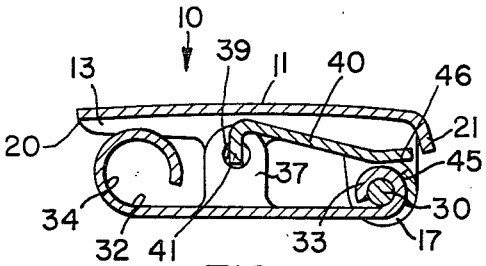
FIG. 5 is a vertical sectional view, taken on line 5—5 of FIG. 3.
Figure 6:
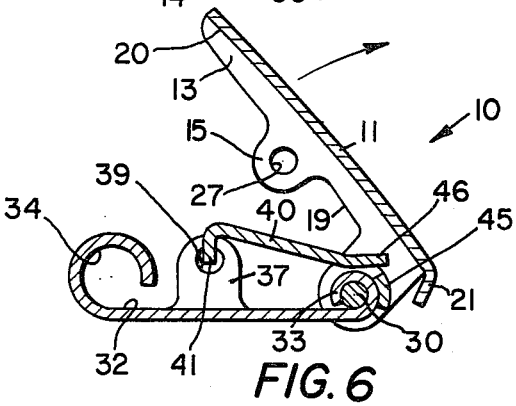
FIG. 6 is a view similar to FIG. 5, showing the cover in half open position with the lock plate in locked position whereby a chain link may be placed in position in the cranking plate, as shown in dot and dash in FIG. 1.
Figure 7:
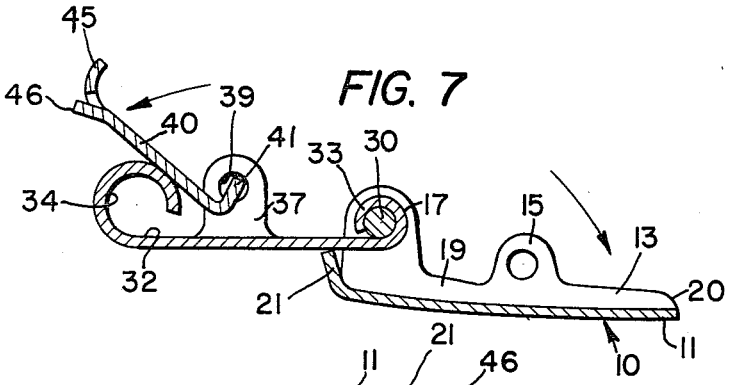
FIG. 7 is a view similar to FIG. 6, showing the cover in fully opened position in relation to the clamping plate and with the lock plate in unlocked position for the placement of a chain link, as shown in dot and dash in FIG. 1.
Figure 8:
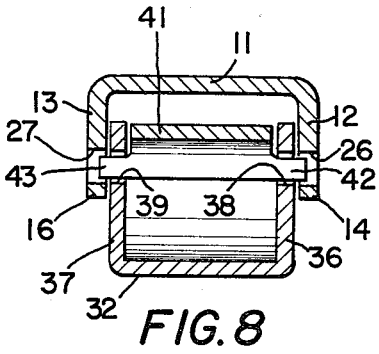
FIG. 8 is a vertical cross sectional view, taken on line 8—8 of FIG. 4.
Figure 9:
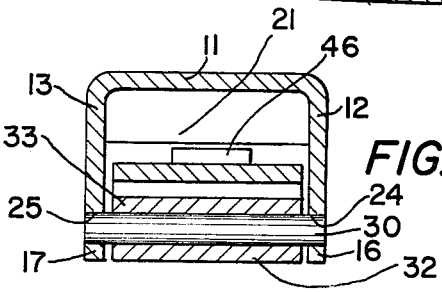
FIG. 9 is a vertical cross sectional view, taken on line 9—9 of FIG. 4.

In operation, attention is directed to FIGS. 1 and 6, wherein the free end link of a necklace chain "A" will be arranged to engage eye 34. The pivoted locked position of the lock plate 40 with bearing 33 and the pivoted open position of cover 11 in relation to clamp plate 32 make this function possible. Reference is now made to FIG. 7 wherein cover 11 is placed in full open position and lock plate 40 is pivoted against eye 34, disengaged from bearing 33. The other free end "B" of a necklace chain will be placed in the opening formed between arms 36, 37 and bearing 33 and against clamp plate 32. Lock plate 40 is then pivoted into locked position when latch hook 45 embraces clamp plate bearing 33 as shown in FIG. 6. Cover body 11 is then pivoted around pintle 30 until lock openings 26, 27 engage, respectively, hinge pins 42, 43 in catch or locked position as shown in FIGS. 1, 4, 5 and 8. To open jewelry clasp 10 cover 11 is pivoted around pintle 30 (see FIGS. 2, 6 and 7), and lock plate 40 is pivoted away from bearing 33 (see FIG. 7). Tail 21 prevents the pivotal release of lock plate 40 from engagement with bearing 33 by means of a member being slid through the opening provided by the removal of tail 21, as seen in FIG. 5. It will be seen that cover 11 overlies and prevents pivotal movement of lock plate 40 when cover 11 is in closed position, as seen in FIGS. 1, 4 and 5.

Having shown and described a preferred embodiment of the present invention by way of example, it should be realized that structural changes could be made and other examples given without departing from either the spirit or scope of this invention.

What we claim is:

1. A double fold over jewelry clasp comprising a cover body having means to provide a pintle bearing and oppositely located lock openings, a pintle fastened in said pintle bearing, a clamp plate having a clamp plate bearing on one end and a link eye in the opposite end, means providing hinge pin openings in said clamp plate, said clamp plate bearing being mounted upon said pintle, a lock plate provided with a hinge pin, having catch means, on one end, and a latch hook and finger nail grip on the other end, said hinge pin mounted in said hinge pin openings, wherein pivoting fold over movement of said clamp plate, forces said hook into engagement with said clamp plate bearing, and pivoting fold over movement of said cover body in a direction opposite to the pivoting fold over movement of said clamp plate, forces said lock openings into engagement with said catch means, and means provided between said lock plate and said clamp plate for the attachment of a chain link, said cover overlying said lock plate to prevent displacement of said latch hook with said clamp plate bearing.

2. A double fold over jewelry clasp comprising a cover having two oppositely located parallel sides, each said sides having a short leg and a long leg separated by an opening, each said short leg provided with a pintle bearing, and each said long leg provided with a lock opening, a pintle, means fastening opposite ends of said pintle in said, respective, pintle bearing, a clamp plate provided with a clamp plate bearing on one end, a chain link eye in the opposite end, and parallel arms having hinge pin openings projecting therefrom, said clamp plate bearing mounted upon said pintle, a lock plate provided on one end with a hinge plate having hinge pins projecting from opposite sides to provide catch means and on the other end with a latch hook and a finger nail grip, said hinge pins mounted in said, respective, hinge pin openings, wherein pivoting fold over movement of said clamp plate, forces said hook into engagement with said clamp plate bearing, and wherein pivoting fold over movement of said clamp body in a direction opposite to the pivoting fold over movement of said clamp plate, forces said lock openings into engagement, respectively, with said hinge pin catch means, whereby said lock plate in cooperation with said openings provides means for the attachment of a chain link, said cover overlying said lock plate to prevent displacement of said hook with said clamp plate bearing.

3. A double fold over jewelry clasp comprising a cover body having a moderately curved shape and two oppositely located parallel sides at right angles to said cover body each said sides having a short leg and a long leg with an opening between, said cover body having a finger nail surface on one end and a tail guard on the other end, each said short leg provided with a pintle bearing and each said long leg provided with a lock opening, a pintle, means fastening opposite ends of said pintle in said, respective, pintle bearing, a clamp plate provided with a clamp plate bearing on one end, a chain link eye in the opposite end, and provided with oppositely located and parallel arms having hinge pin openings, said clamp plate bearing oscillatedly mounted upon said pintle, a lock plate provided on one end with a hinge plate having hinge pins projecting from opposite sides, to provide catch means, and on the other end with a latch hook and a finger nail grip, said hinge pins oscillatedly mounting said hinge pins in its, respective, hinge pin openings, wherein pivoting fold over movement of said clamp plate, forces said hook into engagement with said clamp plate bearing, and pivoting fold over movement of said clamp body in a direction opposite to the pivoting fold over movement of said clamp plate forces said lock openings into engagement, respectively, with said hinge pin catch means, whereby said lock plate in cooperation with said openings provides means for the attachment of a chain link, said cover body overlying said lock plate to prevent displacement of said hook with said clamp plate bearing.

* * * * *